United States Patent [19]

Benford

[11] Patent Number: 4,666,535

[45] Date of Patent: May 19, 1987

[54] METHOD OF PRODUCING LOW CORE LOSSES IN ORIENTED SILICON STEELS

[75] Inventor: James G. Benford, Pittsburgh, Pa.

[73] Assignee: Allegheny Ludlum Corporation, Pittsburgh, Pa.

[21] Appl. No.: 852,058

[22] Filed: Apr. 15, 1986

[51] Int. Cl.[4] ..... H01F 1/04

[52] U.S. Cl. ..... 148/113; 148/27; 148/28

[58] Field of Search ..... 148/113, 27, 28

[56] References Cited

U.S. PATENT DOCUMENTS

| | | | |
|---|---|---|---|
| 3,207,636 | 9/1965 | Wada et al. | 148/113 |
| 3,670,278 | 6/1972 | Foster et al. | 148/113 |
| 3,700,506 | 10/1972 | Tanaka et al. | 148/111 |
| 3,905,842 | 9/1975 | Grenoble | 148/111 |
| 4,096,000 | 6/1978 | Wada et al. | 148/27 |
| 4,096,001 | 6/1978 | Arendt et al. | 148/113 |
| 4,116,730 | 9/1978 | Arendt et al. | 106/112 |
| 4,160,681 | 7/1979 | Miller, Jr. | 148/111 |
| 4,179,315 | 12/1979 | Miller, Jr. | 148/113 |
| 4,200,477 | 4/1980 | Datta et al. | 148/113 |

FOREIGN PATENT DOCUMENTS

| | | |
|---|---|---|
| 1578911 | 11/1980 | United Kingdom . |
| 1578912 | 11/1980 | United Kingdom . |

*Primary Examiner*—John P. Sheehan

*Attorney, Agent, or Firm*—Patrick J. Viccaro

[57] ABSTRACT

A method is provided for improving core-loss values of grain-oriented silicon steel after final texture annealing by boronizing the steel to levels of 0.001 to 0.009 wt. % after applying a boron-containing material to the final texture annealed steel, heating to 1850° to 2200° F., maintaining the steel at such temperature to infuse boron into other steel, and cooling the steel at a rate of 100° F./hour or less.

9 Claims, No Drawings

METHOD OF PRODUCING LOW CORE LOSSES IN ORIENTED SILICON STEELS

BACKGROUND OF THE INVENTION

1. Field of the Invention

This invention relates to the production of grain-oriented silicon steel having very low core losses in such steel by boron infusion and heat treatment after final texturizing annealing.

2.Description of the Prior Art

There has been a long history in the steel industry of the production of steel containing 2.5 to 4% of silicon for electrical purposes. The production of such steel includes one or more cold rolling reductions with intermediate annealing if more than one cold reduction is practiced, and then the steel is final texture annealed to develop a desired grain-oriented texture. The grain-oriented texture is associated with obtaining lower core-loss values when the electrical-steel product is subsequently used, as, for example, to make a wound-core transformer or a stacked core transformer.

The matters of principal concern to producers and users of oriented silicon steel are electrical permeability and core loss properties and production cost. Efforts to yield favorable electrical properties include defining particular compositions to the steel, conditions for the rolling, annealing, compositions of and the manner of application of the separating-medium coating applied before final texturizing annealing. In recent years a reduction to the gage occurred for regular oriented silicon steel, i.e., steel having an induction greater than 1.870 tesla at 8 ampere turns per centimeter, and a relatively low core loss, such as not more than 0.720 watts per pound at 17 kilograms and 60 cycles per second, which corresponds roughly to 0.510 watts per pound at 15 kilogauss and 60 cycles per second, as referred to in some of the older references in the art. As the gage of the steel is reduced there is a tendency for the grain size to increase which is generally accompanied by an increase in the domain size. This tends to increase the eddy-current component of the electrical losses deriving from the domain wall motion which partly offsets the decrease in the classical eddy-current losses accrued from the gage reduction.

It is known in the art of making grain-oriented silicon steel to use steels containing a small amount of boron; see U.S. Pat. No. 3,905,842 and U.S. Pat. No. 4,096,001. This prior art teaches the inclusion of both boron and nitrogen in small quantities in the steel, as it is melted, to promote secondary recrystallization during the final texture-developing anneal.

As disclosed, for example, in U.S. Pat. No. 4,096,000, it is known in the art to provide an annealing separator for silicon steel sheets which contains more than 90% by weight of magnesium oxide and between 0.01 to 2.0% by weight of $B_2O_3$. There are numerous other patents which teach the application of a coating to the steel before the final texturizing anneal which contains, in most cases, a major portion of magnesium oxide and a minor amount of a compound of boron. Other patents disclosing annealing separators include U.S. Pat. Nos. 4,096,001 and 4,116,730 and their British counterparts, Nos. 1578911 and 1578912; as well as U.S. Pat. Nos. 3,700,506; 4,160,681; 4,179,315; and 4,200,477. However, a boron-containing material was always applied before, never after the final texturizing anneal. Slurries used as an annealing separator applied before the texture anneal serve several important functions: (1) a separating medium to prevent welding of coil wraps, (2) a reactant with $SiO_2$ on the steel surface to form forsterite, (3) a reservoir for impurities and (4) a source of elements or compounds that in one way or another provide for an improved secondary recrystallization by interaction with the steel during texture formation. The foregoing patents all disclose recipes for MgO slurry designed to accomplish the above functions more effectively, and are often designed to interact with specific elements in the steel to be texture annealed.

After the final texturizing anneal of the steel to improve the observed core-loss values, it is known to apply a tensile-stress-inducing coating and/or to apply laser scribing to reduce the 180 degree domain wall spacing. Although laser scribing often yields excellent core-loss values, it is expensive to practice, and the benefits of the scribing operation are lost when stress-relief annealing of the textured steel is carried out for use in a core transformer.

BRIEF SUMMARY OF THE INVENTION

It is an object of the present invention to boronize oriented silicon steel after final texture annealing to levels of 0.001 to 0.009 weight percent at 1850 to 2200 degrees Fahrenheit with subsequent cooling of the steel at a rate of 100 degrees Fahrenheit or less per hour for providing such steel with reduced core losses.

According to the present invention, a carrier coating which essentially includes boron is applied to oriented silicon steel after the final texturizing anneal and the so-coated steel is heat treated at 1850 to 2200 degrees Fahrenheit, followed by a relatively slow cooling at a rate of 100 or less degrees Fahrenheit per hour to obtain a high-permeability, low-core-loss electrical-steel product. The properties of the electrical-steel product of the present invention are unaffected by subsequent fabrication operations including a stress-relief annealing operation. The post-texture anneal boronizing treatment of the present invention yields a product having relatively large (approximately 35 microns long) particles of iron boride ($Fe_2B$) which are visible in a microscope at a magnification of 100 diameters. Development of these iron boride particles appears to correspond with obtaining improved (lower) core loss values. It is believed that the larger iron boride particles serve as demagnetization centers which decrease the 180 degree domain wall spacings, regardless of whether the steel initially contained boron or not. For applications in which subsequent stress-relief annealing is not to be practiced, the post-texturizing boronizing process of the present invention may be combined with laser scribing to obtain core-losss values which are improved even further. Such boride particles do tend to increase slightly the hysteresis loss component of the total losses. It is found, however, in accordance with the invention that the formation of the larger boride particles yields a reduction in eddy-current losses which exceeds any increase in hysteresis losses.

DESCRIPTION OF THE PREFERRED EMBODIMENTS

In the practice of the invention, a boronizing coating material is applied to grain-oriented silicon steel in which the desired texture has already been developed by the practicing of a texturizing anneal, and when the boronizing-treatment material has been applied to the steel and the coated steel is then subjected to an appropriate heat treatment at 1850 to 2200 degrees Fahrenheit, followed by slow cooling at a rate not greater than 100 degrees Fahrenheit per hour, there is obtained a permanent improvement in the core-loss properties of the steel which has been so treated. Moreover, the core-loss properties so improved may be further enhanced by the practice of applying a tensile-stress-inducing finish coating and/or by scribing.

The present invention is applicable to grain-oriented silicon steel independent of whether the steel melt contains boron. The invention may be considered as applying to any iron alloy containing 2.5 to 4% by weight silicon, uup to 0.12% by weight of manganese, and the balance being unavoidable impurities. The boronizing process of the present invention is useful for all of the oriented silicon steels, whether of the so-called regular or conventional type or of the high-permeability type, such steels containing typically less than 0.003% carbon, 0.03 to 0.08% manganese, less than 0.0005% sulfur, 2.9 to 3.2% silicon, less than 0.25% copper, less than 0.1% tin, less than 0.0015% aluminum, less than 0.0015% titanium, less than 0.005% oxygen, less than 0.0005% nitrogen, and low concentrations of unavoidable residual elements such as chromium, nickel, phosphorus, and molybdenum, the percentages being by weight and the balance being iron.

The steel or iron-silicon alloy is usually in the form of having been reduced to a thickness on the order of 0.005 to 0.014 inch thick, and as aforesaid, it has been processed through a texturizing anneal to develop therein the desired grain orientation.

The exact composition of the boronizing-treatment material which is applied to the texturized steel or iron-silicon alloy is not believed to be critical, so long as it contains an appropriate proportion of an effective boronizing material, such as 0.5 to 5% by weight of boron in a suitable carrier, such as magnesium oxide. The boron may be derived from any of a variety of boron compounds, but I have found boric acid to be inexpensive and effective. The only requirement of the boron compound is that it readily give up its boron at elevated temperatures so that the boron may diffuse into the steel. Magnesium oxide is the preferred carrier of the slurry because of the wide spread use of this material as part of the anneal separation coating used during the texture annealing steel. The boronizing treatment material may be applied in any of a variety of ways, but is most practically done by the usual dipping and metering process employed by producers of oriented silicon steels.

The amount of boron available to diffuse into the steel is important, and this is assured by careful control of the amount of boron in the applied coating and by the weight of that coating applied per square meter of steel. The amount of boron available to the steel should be between 0.04 to 0.10 grams per square meter of steel, preferably 0.07 grams. For example, and MgO slurry containing by weight 0.75 percent of boron as cured and applied to a weight of 9.2 grams per square meter of steel works very well.

Satisfactory results are obtained by heating the coated grain-oriented silicon steel to a temperature of 2150 degrees Fahrenheit and holding the steel at this temperature for 2 to 4 hours, before commencing a slow cooling at not greater than 100 degrees Fahrenheit per hour, preferably about 50 degrees Fahrenheit per hour. A soaking time for the heated steel of 1 hour to 12 hours or more may be used.

Tests have been conducted in which a cooling rate greater than 100 degrees Fahrenheit per hour was used after the above-mentioned soaking. The results of the test reveal a steel product that does not exhibit the desired low core-loss values which are obtained with the steel product treated in accordance with the invention. Further details are included in the examples hereinbelow.

EXAMPLE 1

There was prepared in accordance with known methods a quantity of grain-oriented silicon steel having a thickness of 0.0087 inch and a chemical composition of, in weight percent, 0.0022 C, 0.063 Mn, less than 0.0005 S, 3.15 Si, 0.0006 Al, 0.0015 Ti, 0.0018 B, 0.0022 O, less than 0.0005 N, balance Fe. This steel was in the fully-texture-annealed condition, and was a high-permeability steel, exhibiting a flux density of 1.957 tesla at an induction ($B_8$) of 8 ampere-turns per centimeter.

Two specimens A and B of such steel were prepared. Specimen A was left untreated as a control. The Specimen B was coated with a magnesium oxide slurry containing 1.5 weight percent of boron. The Specimen B was then heated to 2100 degrees Fahrenheit and held at that temperature for 2 hours, and then cooled at the rate of 50 degrees Fahrenheit per hour.

After such treatment, the electrical properties of the Specimens A and B were determined, with the results presented below in Table I. The steel of Specimen B was analyzed for its boron content, exhibiting a value of 39 parts per million in comparison with the value of 18 parts per million for the steel of the untreated Specimen A.

TABLE I

| Specimen | $B_8$ Tesla | Core Loss-wpp @ 60 Hz 1.3 T | 1.5 T | 1.7 T |
|---|---|---|---|---|
| A | 1.957 | 0.32 | 0.42 | 0.57 |
| B | 1.952 | 0.28 | 0.37 | 0.48 |

Further testing was conducted to determine the extent to which there could be further improvements in the core-loss values of Specimen B by the known practices of (1) applying a tensile-stress-inducing finish coating and (2) scribing. Compared to similar treatments of Sample A, in Table II, there are presented the results for Sample B, along with the data for Sample A, indicating the values normally obtained when a high-permeability grain-oriented silicon steel not subjected to the treatment of the invention is likewise finish-coated or scribed. The finish-coating exerted a tension of 1500 pounds per square inch, and the scribing was applied at intervals of 5 millimeters.

TABLE II

| | $B_8$, Tesla | Core Loss, wpp @ 60 Hz 1.3 T | 1.5 T | 1.7 T |
|---|---|---|---|---|
| Specimen B - Boronized but not Further Treated | 1.952 | 0.28 | 0.37 | 0.48 |
| Specimen B - Boronized and Finish-Coated | 1.954 | 0.27 | 0.36 | 0.47 |
| Specimen B - Boronized and scribed | 1.942 | 0.27 | 0.36 | 0.48 |
| Specimen A - Untreated | 1.957 | 0.32 | 0.42 | 0.57 |

TABLE II-continued

| | $B_8$, Tesla | Core Loss, wpp @ 60 Hz 1.3 T | 1.5 T | 1.7 T |
|---|---|---|---|---|
| Specimen A - Finish Coated | N.D. | 0.30 | 0.40 | 0.54 |
| Specimen A - scribed | N.D. | 0.26 | 0.36 | 0.47 |

N.D. = not determined

It is clear that the boronizing treatment results in a steel with core losses essentially as low as can be gotten by scribing and lower than is obtained by finish coating alone on non-boronized steel. The advantage of boronized steel over a non-boronized steel that is scribed is that the low losses of the boronized steel will withstand customers' stress relief anneals while non-boronized steels that are scribed will suffer an increase in core losses in said stress relief anneals.

EXAMPLE 2

Example 1 was repeated, except that there was used a steel of a similar composition as before, but with only 0.035% manganese, and with the boron level at 30 to 40 parts per million, and with different gages as indicated in Table III, below, and with heating at 2150 degrees Fahrenheit for 4 hours. The results were:

TABLE III

| Sample | Gage mils | $B_8$ Tesla | Core Loss, wpp @ 60 Hz 1.3 T | 1.5 T | 1.7 T | Boron, ppm |
|---|---|---|---|---|---|---|
| C - Before | 9.1 | 1.935 | 0.31 | 0.42 | 0.54 | 30–40 |
| C - After | | 1.926 | 0.30 | 0.40 | 0.52 | 76 |
| D - Before | 8.4 | 1.924 | 0.35 | 0.47 | 0.62 | 30–40 |
| D - After | | 1.911 | 0.30 | 0.40 | 0.55 | 83 |
| E - Before | 8.3 | 1.915 | 0.32 | 0.42 | 0.59 | 30–40 |
| E - After | | 1.912 | 0.30 | 0.40 | 0.54 | 82 |

It can be seen that significant reductions in core losses were experienced in all three samples through boronizing to levels of 76 to 83 ppm.

All of the samples C, D, and E were examined, after boronizing, in a microscope at a magnification of 100 diameters and were observed to have readily visible particles of $Fe_2B$; the same samples, likewise examined after coating but before the final boronizing heat treatment at 2150 degrees Fahrenheit for 4 hours, had no such visible particles of $Fe_2B$.

EXAMPLE 3

The process of the present invention was employed on a mill coil that had unacceptably high core loss as originally texture-annealed. The thickness of the coiled strip was, of about 8.8 to 9.0 mils, having a chemical composition nominally the same as that of the Samples C-D-E of Example 2. The flux density at an applied field of 8 ampere-turns per centimeter was 1.920 Tesla at each end of the coil.

Using mill production facilities, the coil was coated with an MgO slurry containing 1.5% boron. The coil was then heat-treated, using a standard mill production cycle of the kind normally used for the texture-annealing of coils, namely, soaking at 2150 degrees Fahrenheit for several hours and then slow-cooling at less than 100 degrees Fahrenheit per hour. The results are presented in Table IV, below.

TABLE IV

| Coil End | Gage, mils | Before wpp @ 60 Hz 1.3 T | 1.5 T | 1.7 T | ppm B | After wpp @ 60 Hz 1.3 T | 1.5 T | 1.7 T |
|---|---|---|---|---|---|---|---|---|
| In | 9.0 | .34 | 0.46 | 0.63 | 110 | 0.32 | 0.42 | 0.57 |
| Out | 8.8 | .34 | 0.46 | 0.62 | 120 | 0.31 | 0.42 | 0.56 |
| Average | | .34 | 0.46 | 0.62 | | 0.32 | 0.42 | 0.56 |
| change (%) | | | | | | −8.4 | −8.9 | −9.1 |

The percentage changes in core losses for the mill-treated coil were as large as those for the laboratory-tested samples of Example 2.

EXAMPLE 4

Large reductions in core losses are observable over a wide range of boron levels, a more important process variable being the rate of cooling from the boronizing treatment. This will be shown by the work discussed hereinbelow.

A sample according to Sample B in Example 1 ($B_8$=1.952T, 39 parts per million of boron) was further treated to study effects of boron level and cooling rate. To this end, there were produced some further Samples F, G, and H, as follows:

Sample F–Sample B, plus boronizing to 65 parts per million of boron, by heating to 2100 degrees Fahrenheit and then cooling at 650 degrees Fahrenheit per hour.

Sample G–Sample B, plus then deboronizing to 30 parts per million of boron, by heating to 2100 degrees Fahrenheit and then cooling at 50 degrees Fahrenheit per hour.

Sample H–Sample B, plus then further deboronizing to 22 parts per million boron by heating to 2100 degrees Fahrenheit and then cooling at 650 degrees Fahrenheit per hour.

The above-mentioned boronizing was accomplished by applying a slurry of magnesium oxide containing a boron-contributing compound, to the extent of having 1.5% by weight of boron in the contained solids of the slurry, and then soaking for a few hours at 2000 to 2200 degrees Fahrenheit, followed by cooling at the indicated rate. The deboronizing is done similarly, but with the use of a magnesium oxide slurry which does not contain boron.

The results of such testing are presented below in Table V.

TABLE V

| Sample | Boron Content ppm | Cooling Rate, F/hr | $B_8$, Tesla | Core Loss, wpp @ 60 Hz 1.3 T | 1.5 T | 1.7 T |
|---|---|---|---|---|---|---|
| B | 39 | 50 | 1.952 | 0.28 | 0.37 | 0.48 |
| F | 65 | 650 | 1.944 | 0.38 | 0.51 | 0.66 |
| G | 30 | 50 | 1.947 | 0.31 | 0.41 | 0.54 |
| H | 22 | 650 | 1.946 | 0.35 | 0.47 | 0.63 |

Whether the steel contained 65 parts per million of boron as in Sample F or 22 parts per million of boron as in Sample H, the core losses were unacceptably high when the steel was cooled rapidly at a rate of 650 degrees Fahrenheit per hour. In contrast, when the steel was cooled slowly, at about 50 degrees F./hr, the core-loss values were good, whether the boron level in the steel after the treatment according to the invention was 30 parts per million (Sample G), 39 parts per million (Sample B) or 82 parts per million (Sample E, Table III).

Pieces from Samples G and H were examined in planar view for the size and distribution of $Fe_2B$ particles. The longest dimension seen for any particle was used as a designation of its size.

TABLE VI

| 50 F/hr | 30 ppm B 50 F/hr | | 22 ppm B 650 F/hr | |
|---|---|---|---|---|
| Particle Size, um | % | Cum % | % | Cum % |
| 0-10 | 14 | 14 | 30 | 30 |
| 11-20 | 23 | 37 | 60 | 90 |
| 21-30 | 26 | 63 | 8 | 98 |
| 31-40 | 11 | 74 | 2 | 100 |
| 41-50 | 8 | 82 | | |
| 51-60 | 2 | 84 | | |
| 61-70 | 3 | 87 | | |
| 71-80 | 4 | 91 | | |
| 81-90 | 2 | 93 | | |
| 91-110 | 2 | 95 | | |
| 111-130 | 2 | 97 | | |
| 131-150 | 2 | 99 | | |
| >150 | 1 | 100 | | |
| Avg. Size | 35.0 μm | | 12.4 | |
| Particles/mm | 3.8 | | 18.0 | |

It is apparent that slow cooling allows coarsening of $Fe_2B$ to occur, thus increasing the average particle size, decreasing the number of particles observed per square millimeter, and decreasing the number of particles less than 40 micro meters.

Without wishing to bound by theory, and on the basis of the above data on boride size, it is believed that mechanisms for improvement with slow cooling and degradation of losses with fast cooling are as follows. When cooled slowly, as observed, large $Fe_2B$ particles form (e.g., >40 μm) and serve as demagnetization centers which decrease the 180 degrees domain wall spacings. Indeed, a determination of the hysteresis losses, $P_H$, before and after the boronizing treatment of Example 1 revealed that hysteresis losses increased by 11 to 21% due to boronizing depending on the test induction (higher percentages at higher inductions). However, the eddy current losses, $P_E$, which represent about 80% of the total losses, were reduced by 17 to 22% (higher percentages at higher inductions).

The foregoing data appear to support a theory that with slower cooling, large particles of $Fe_2B$ (greater than 40 microns) are formed and serve as demagnetization centers which decrease the 180 degree domain wall spacings.

A loss separation was performed on Samples A and B from Table I; that is the hysteresis losses were measured for each sample at each test induction. The difference between the total losses and their respective hysteresis losses, $P_H$, are the eddy-current losses, $P_E$. The data are shown in Table VII.

TABLE VII (Cooled at 50° F./hr)

| | wpp @ 60 Hz 1.0 T | | | 1.3 T | | | 1.5 T | | | 1.7 T | | |
|---|---|---|---|---|---|---|---|---|---|---|---|---|
| | $P_T$ | $P_H$ | $P_E$ | $P_T$ | $P_H$ | $P_E$ | $P_T$ | $P_H$ | $P_E$ | $P_T$ | $P_H$ | $P_E$ |
| 18 ppm B | 0.19 | 0.04 | 0.15 | 0.32 | 0.06 | 0.26 | 0.42 | 0.09 | 0.33 | 0.57 | 0.12 | 0.45 |
| 39 ppm B | 0.17 | 0.05 | 0.12 | 0.28 | 0.07 | 0.21 | 0.37 | 0.10 | 0.27 | 0.48 | 0.14 | 0.34 |

Certainly the total boride volume present depends on the amount of boron available and in addition to the large borides, there are also some very small borides formed that increase the coercive forces, and thus the hysteresis losses slightly. However, the domain refinement caused by the large borides results in an overwhelming reduction in eddy-current losses and thus in total losses. Rapid cooling, on the other hand, produces no large borides and thus no domain refinement while resulting in large quantities of the fine borides that greatly increase the coercive forces and hysteresis losses and may increase asynchronous eddy current losses as domain walls encounter many boride obstructions to their movements. Indeed through the loss separation studies, such increases were observed.

A loss separation was also performed on Sample F from Table V and results are shown in Table VIII.

TABLE VIII

| | wpp @ 60 Hz 1.0 T | | | 1.3 T | | | 1.5 T | | | 1.7 T | | |
|---|---|---|---|---|---|---|---|---|---|---|---|---|
| | $P_T$ | $P_H$ | $P_E$ | $P_T$ | $P_H$ | $P_E$ | $P_T$ | $P_H$ | $P_E$ | $P_T$ | $P_H$ | $P_E$ |
| Fast Cooled 650° F./hr Cooling | 0.24 | 0.07 | 0.17 | 0.38 | 0.10 | 0.28 | 0.51 | 0.13 | 0.38 | 0.66 | 0.18 | 0.48 |

The hysteresis losses seen are significantly higher than those for the slow-cooled samples of Table VII and the eddy-current losses were higher because of the dispersion of the fine $Fe_2B$ created by rapid cooling. Observations of the domain structures indicated that domain wall spacings were significantly larger in fast-cooled samples, thus accounting for the very high eddy-current losses in Table VIII.

All oriented silicon steels, whether of the so-called regular or conventional type or of the high-permeability type after fully texture annealing, have nearly identical chemistries in weight percent: 0.003 C, 0.03 to 0.08 Mn, less than 0.0005 S, 2.9 to 3.2 Si, less than 0.25 Cu, less than 0.1 Sn, less than 0.0015 Al, less than 0.0015 Ti, less than 0.0050 Oxygen, and less than 0.005 Nitrogen and low concentrations of unavoidable residual elements such as Cr, Ni, P and Mo.

Consequently, since all regular oriented silicon steels and all high-permeability oriented silicon steels are essentially identical crystallographically, their responses to boronizing will be very similar. The responses will be greater in the high-permeability steels, particularly in those with large 180 degree domain wall spacings, compared to regular oriented steels in which domain wall spacings are typically smaller. The effectiveness of the process of this invention is dependent on the crystallography of the material and the 180 degree domain wall spacing and bears no relationship to the steelmaking chemistry and processing used to produce said crystallography and domain-wall spacing.

The lower losses achieved by boronizing are permanently lower and unaffected by subsequent stress relief annealing in the transformer core manufacturing process. In the wound-core transformer business, where finish coatings are not required for insulation purposes, a base coated material produced by the method of the present invention could be produced at less cost than a finish-coated and scribed material and provide said businesses with core losses as good as any available. For the stacked transformer business where there are insulation requirements but no stress relief annealing requirements, the product of the current invention can be produced with losses competitive with those of "scribed" products without the requirement of costly investment and maintenance of a commercial scribing apparatus. Indeed the result of the process of this invention is much the same as that achieved by laser scribing, and the result is achieved for the same reason—domain-wall-spacing reduction.

While I have shown and described herein certain embodiments of my invention, I intend to cover any change or modification therein which may be made without departing from its spirit and scope.

I claim as my invention:

1. A method of improving the core-loss values of grain-oriented silicon steel having between 2.5 to 4 weight percent silicon and the balance iron except for unavoidable impurities after final texture annealing, said method including the steps of:

applying to the final texture-annealed steel a boron-containing material, heating the steel with the boron-containing material thereon to a temperature of 1850 to 2200 degrees Fahrenheit, maintaining the steel at such temperature for a period of time sufficient to infuse boron from said boron-containing material into said steel to between 0.001 and 0.009 weight percent boron, and cooling the steel at a rate of 100 or less degrees Fahrenheit per hour down to a temperature of about 1000 degrees Fahrenheit.

2. The method according to claim 1 wherein said step of cooling further comprises cooling said steel at a rate of about 50 degrees Fahrenheit per hour.

3. The method according to claim 2 wherein the steel with the boron-containing material thereon is heated to a temperature of between 2000 and 2150 degrees Fahrenheit.

4. The method according to claim 1 wherein said steel is boronized to between 0.0015 and 0.0050 weight percent by said step of maintaining temperature.

5. The method according to claim 4 wherein said step of cooling is further defined by cooling the steel at a rate not in excess of 50 degrees Fahrenheit per hour.

6. The method according to claim 1 wherein said boron-containing material essentially includes magnesium oxide and said boron.

7. The method according to claim 1 wherein said step of maintaining temperature is further defined to include maintaining the steel at said temperature for 1 to 12 hours.

8. The method according to claim 1 wherein said step of maintaining temperature is further defined to include maintaining the steel at said temperature for 2 to 4 hours.

9. A method of improving the core-loss values of grain-oriented silicon steel having between 2.5 to 4 weight percent silicon and the balance iron except for unavoidable impurities after final texture annealing, said method including the steps of:

applying to the final texture-annealed steel a boron-containing material at a coating weight of 0.04 to 0.10 grams of boron per square meter of steel, heating the steel with the boron-containing material thereon to a temperature of 1850–2200 degrees Fahrenheit, maintaining the steel at such temperature for a period of time sufficient to infuse the boron from said boron-containing material into said steel to between 0.001 and 0.009 weight percent boron, and cooling the steel at a rate of 100 or less degrees Fahrenheit per hour down to a temperature of about 1000 degrees Fahrenheit.

* * * * *